US006097111A

United States Patent [19]

Anrod

[11] Patent Number: 6,097,111

[45] Date of Patent: Aug. 1, 2000

[54] MODE SELECTABLE POWER RECEPTACLE

[76] Inventor: Stephen C. Anrod, 2970 N. Lake Shore Dr., 18C, Chicago, Ill. 60657

[21] Appl. No.: 09/224,064

[22] Filed: Dec. 29, 1998

[51] Int. Cl.[7] ..... H01H 19/00

[52] U.S. Cl. ..... 307/115; 307/116; 307/125; 307/139

[58] Field of Search ..... 307/139, 126, 307/115, 125, 116; 439/535; 174/53

[56] References Cited

U.S. PATENT DOCUMENTS 3,872,319 3/1975 Platzer, Jr. ..... 307/114
4,383,186 5/1983 Liang ..... 307/113
4,578,593 3/1986 Davidov ..... 307/113
5,574,319 11/1996 Bennett ..... 307/114

*Primary Examiner*—Jeffrey Gaffin
*Assistant Examiner*—Sharon Polk
*Attorney, Agent, or Firm*—Michael R. McKenna

[57] ABSTRACT

A mode selectable power receptacle includes an outlet receptacle adapted to receive a plug having first and second terminals. A two position switch is connected to a hot terminal, a switched hot terminal, and a second side of the outlet receptacle. The switch includes an actuator for selectively operating the switch to connect the second side to either the hot terminal or the switched hot terminal to selectively power the outlet receptacle directly from the hot line or through the remote switch from the hot line.

20 Claims, 1 Drawing Sheet

MODE SELECTABLE POWER RECEPTACLE

FIELD OF THE INVENTION

This invention relates to a control for an electrical power receptacle and, more particularly, to a local switch in the power receptacle.

BACKGROUND OF THE INVENTION

In providing electrical circuits to a facility, such as a home, a power receptacle includes one or more outlet receptacles hardwired to a supply, such as a 120 volt AC supply. Typically, the outlet receptacle is hardwired to a breaker or fuse panel so that electric power is always present at the outlet receptacle. A load device can then be controlled according to whether or not it is plugged into the outlet receptacle. Alternatively, if the load device includes its own switch, then it can remain plugged into the outlet receptacle and the device switch used to turn the device on or off.

With some load devices, such as a lamp, it is often desirable to turn the lamp on when one enters a room where the lamp is located. This cannot normally be done with the above described circuit. To satisfy this desire, the outlet receptacle may be wired to the supply through a wall switch. The lamp switch is left in the on position. The lamp is thus turned on or off by controlling the wall switch to selectively apply power to the lamp via the outlet receptacle.

To accomplish both of the above in a single power receptacle, dual outlet receptacles are available in which each outlet receptacle is separately wired. Within each room, one outlet receptacle of each pair may be hardwired directly to a hot circuit, while the other outlet receptacle of the pair is wired to the wall switch. This allows devices such as lamps to be positioned in different parts of a room to be controlled from the wall switch, while also allowing other devices such as radios or the like to be located in different positions in the same room to be controlled individually.

It is clear that different wiring techniques can be used to satisfy virtually any desire. However, once the hard wiring is actually made, then it can prove quite difficult and expensive to change the configuration. For example, it might be necessary to replace a power receptacle or change wiring to the power receptacle in order to change its operation.

The present invention is directed to overcoming one or more of the problems discussed above in a novel and simple manner.

SUMMARY OF THE INVENTION

In accordance with the invention there is provided a mode selectable power receptacle.

Broadly, there is disclosed herein a mode selectable power receptacle including an outlet receptacle adapted to receive a plug having first and second terminals. A neutral terminal for electrical connection to a neutral line of a supply is connected to a first side of the outlet receptacle. A hot terminal is provided for electrical connection to a hot line of the supply. A switched hot terminal is provided for electrical connection via a remote switch to the hot line of the supply. A two position switch is connected to the hot terminal, the switched hot terminal, and a second side of the outlet receptacle. The switch includes an actuator for selectively operating the switch to connect the second side to either the hot terminal or the switched hot terminal to selectively power the outlet receptacle directly from the hot line or through the remote switch from the hot line.

It is a feature of the invention that the switch comprises a push button switch.

It is another feature of the invention that the switch comprises a maintained push button switch.

It is a further feature of the invention that the switch comprises a momentary push button switch.

It is an additional feature of the invention that the switch comprises a selector switch.

It is still a further feature of the invention that the switch comprises a relay. A control circuit operates the relay. The control circuit includes a selector switch.

It is an additional feature of the invention to provide a housing for the outlet receptacle and the switch, the terminals being externally mounted to the housing.

It is yet another feature of the invention that a ground terminal for connection to a ground line is connected to a ground receptacle of the outlet receptacle.

In accordance with another aspect of the invention there is disclosed a mode selectable power receptacle including first and second outlet receptacles each adapted to receive a plug having first and second terminals. A neutral terminal for connection to a neutral line of the supply is connected to a first side of each outlet receptacle. A hot terminal is provided for electrical connection to a hot line of the supply. A switched hot terminal is provided for electrical connection via a remote switch to the hot line of the supply. First and second two position switches are connected to the hot terminal, the switched hot terminal, and a second side of the respective first and second outlet receptacles. Each switch includes an actuator for selectively operating the respective switch to connect the respective second side to either the hot terminal or the switched hot terminal to selectively power the respective outlet receptacle directly from the hot line or through the remote switch from the hot line.

Further features and advantages of the invention will be readily apparent from the specification and from the drawings.

DETAILED DESCRIPTION OF THE INVENTION

Figure 1:
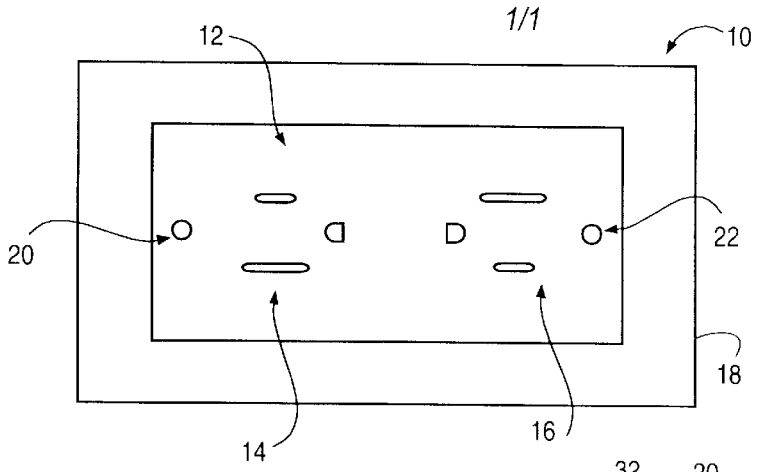
FIG. 1 is an elevation view of a mode selectable power receptacle according to a first embodiment of the invention.

Referring to FIG. 1, a mode selectable power receptacle 10 according to the invention is illustrated. The power receptacle 10 includes a housing 12 supporting a first outlet receptacle 14 and a second outlet receptacle 16. In the illustrated embodiment of the invention, the housing 12 is of a generally parallelepiped configuration to be received in a conventional junction box. As will be appreciated, any housing configuration can be utilized in accordance with the invention. A cover plate 18 is used for surrounding the housing 12 once installed in a junction box. In accordance with the invention, the first outlet receptacle 14 includes a push button switch 20 to control its operation, as discussed more specifically below. Likewise, the second outlet receptacle 16 includes a push button switch 22 for controlling its operation. More particularly, when one of the buttons 20 or 22 is pushed in, its associated respective outlet receptacle 14 or 16 is in a second mode where power is available directly from a hot line, while when the button is popped out, its associated outlet receptacle 14 or 16 is in a first mode or normal shelf state where power is provided from a remote switch. As used herein, the term "first mode" or "second mode" relates to a mode of operation at the power receptacle 12.

Figure 2:
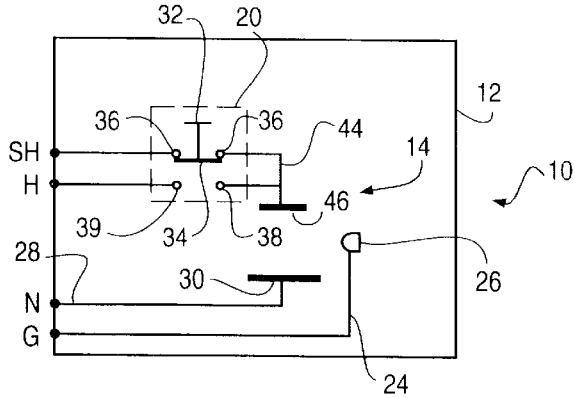
FIG. 2 is an electrical schematic of the power receptacle of FIG. 1.

Referring to FIG. 2, an electrical schematic illustrates a circuit for the outlet receptacle 14. As will be appreciated, a similar schematic would be used for the outlet receptacle 16.

Appropriately secured to the housing 12 are a ground terminal G, a neutral terminal N, a hot terminal H, and a switched hot terminal SH. The ground terminal G is hard wired via a conductor 24 to a female ground receptacle 26. The neutral terminal N is electrically connected via a conductor 28 to a neutral female receptacle 30. The push button switch 20 comprises a two position switch including an actuator 32 operating a movable contact 34. In its normal or unactuated state, the movable contact 34 is in contact with a first set of fixed contacts 36. In an actuated position, when the actuator 32 is depressed, the movable contact 34 is in electrical contact with a second set of fixed contacts 38. In accordance with the invention, the push button switch 20 normally comprises a maintained push button switch in which the actuator 32 is pushed once so that it is then maintained in the actuated position. The actuator 32 would be pushed again to release the switch 20 so that it returns to its normal unactuated position.

In accordance with the invention, the switched hot terminal SH is connected to one of the first set of fixed terminals 36. The hot terminal H is connected to a same side of the second set of fixed terminals 38. The opposite sides of the fixed terminals 36 and 38 are directly connected via a conductor 44 to a hot male receptacle 46 of the outlet receptacle 14.

As is apparent, the receptacles 26, 30 and 46 define a conventional outlet receptacle for receiving a three prong plug, not shown.

In use, the power receptacle 10 is wired so that the ground terminal G is connected to supply ground. The neutral terminal N is connected to supply neutral. The hot terminal H is connected to supply hot. The switched hot terminal SH is connected via a remotely located switch to a hot line of the supply. As such, in its normal configuration, as shown in FIG. 2, the outlet receptacle 14 is in the first mode and power is controlled by the remote switch. If desired to override operation of the remote switch, then the push button switch 20 is actuated so that it is in its second mode. As a result, the movable contact 34 is in contact with the second set of fixed contacts 38 so that the hot terminal H is in electrical connection with the hot receptacle 46. Thus, a local switch is integrally provided in the receptacle that changes from a normal first mode in which power is regulated by the remote wall switch and disconnected directly from the power source, to a second mode where the circuit is completed directly to the power source.

As is apparent, since the second outlet receptacle 16 includes its own push button switch 22, it can be controlled independently of the first outlet receptacle 14.

Figure 3:
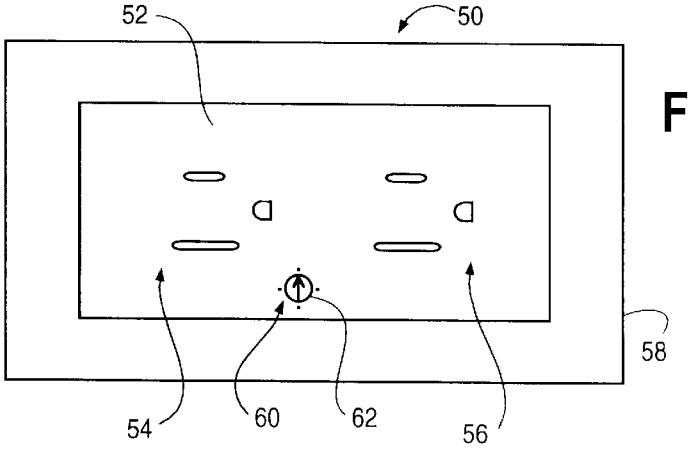
FIG. 3 is an elevation view of a mode selectable power receptacle according to a second embodiment of the invention.

Referring to FIG. 3, an outlet receptacle 50 according to a second embodiment of the invention is illustrated. The power receptacle 50 includes a housing 52 supporting a first outlet receptacle 54 and a second outlet receptacle 56. A cover plate 58 is used similar to the cover plate 18 discussed above. The operation of the power receptacle 50 is similar to the power receptacle 10, except that the two push button switches 20 and 22 are replaced with a slotted control switch 60. The slotted control switch 60 comprises a selector switch using a rotary actuator 62. The actuator 62 can be turned by a small screwdriver to allow selection of one of four modes. In the twelve o'clock position, as shown, both of the outlet receptacles 54 and 56 are in the first mode. When the actuator 62 is turned to the three o'clock position, the first outlet receptacle 54 is in the first mode and the second outlet receptacle 56 is in the second mode. When the actuator 62 is turned to the six o'clock position, both of the outlet receptacles 54 and 56 are in the second mode. Finally, when the actuator 62 is turned to the nine o'clock position, the first outlet receptacle 54 is in the second mode, while the second outlet receptacle 56 is in the first mode.

Figure 4:
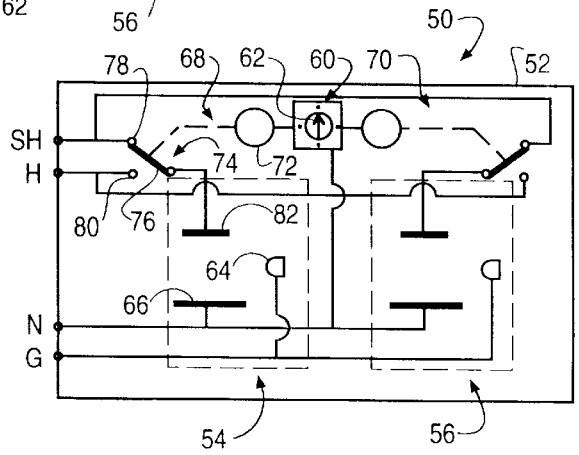
FIG. 4 is an electrical schematic of the power receptacle of FIG. 3.

Referring to FIG. 4, a schematic for the power receptacle 50 is illustrated. As with the power receptacle 10, the power receptacle 50 includes a ground terminal G, a neutral terminal N, a hot terminal H, and a switched hot terminal SH. These terminals can all be wired to a supply as above.

The ground terminal G is electrically connected to a female ground receptacle 64 of the outlet receptacle 54. The neutral terminal N is electrically connected to a female neutral receptacle 66 of the outlet receptacle 54, each defining a first side of the outlet receptacle 54. A first control relay 68 is associated with the first outlet receptacle 54. A second control relay 70 is associated with the second outlet receptacle 56. The relay 68 includes a coil 72 and a two position switch 74. The two position switch 74 includes a movable contact 76 and first and second fixed contacts 78 and 80, respectively. The movable contact 76 is electrically connected to a female hot receptacle 82 of the outlet receptacle 54. The first fixed contact 80 is electrically connected to the switched hot terminal SH. The second fixed contact 80 is electrically connected to the hot terminal H. The coil 72 is operated by the control switch 60. The control switch 60 can be a hard wired circuit which controls the coil 72, as discussed above, to control the switch 74. Alternatively, the control switch 60 can be a programmable device for similarly operating the coil 72, as will be apparent to one skilled in the art.

As is apparent, the outlet receptacle 56 is controlled similar to the outlet receptacle 54, using the second control relay 70, which is similar to the first control relay 68.

Alternatively, as is apparent, the two position switches may be remotely disposed from the electrical power receptacle to selectively power the power receptacle directly from the hot line or through the remote switch from the hot line.

As illustrated in FIG. 4, both outlet receptacles 54 and 56 are in the first mode in which power to each is supplied via the switched hot terminal SH. When the actuator 62 is moved to the three o'clock position, the second relay 70 is actuated so that the second outlet receptacle 56 is powered via the hot terminal H. Similarly, if the actuator 62 is placed in the nine o'clock position, then the first relay 68 is actuated so that the first outlet receptacle 54 is powered by the hot terminal H. Finally, if the actuator 62 is placed in the six o'clock position, then both relays 68 and 70 are actuated so that both outlet receptacles 54 and 56 are connected to the hot terminal H.

As will be apparent, a selector switch could be used that directly actuates the movable contact 76. In this case, separate selector switches would be necessary, such as with the embodiment of FIG. 1. Alternatively, a single selector switch could be used for controlling both outlet receptacles 54 and 56 in unison.

Thus, in accordance with the invention there is disclosed a mode selectable outlet receptacle in which the outlet receptacle can be controlled to be directly connected to a supply or connected via a remote switch to the supply.

I claim:

1. A mode selectable power receptacle for use with a remote switch comprising:

an outlet receptacle adapted to receive a plug having first and second terminals;

a neutral terminal for electrical connection to a neutral line of a supply, the neutral terminal being connected to a first side of the outlet receptacle;

a hot terminal for electrical connection to a hot line of the supply;

a switched hot terminal for electrical connection via the remote switch to the hot line of the supply;

a two-position switch connected to the hot terminal, the switched hot terminal and a second side of the outlet receptacle, the two-position switch including an actuator for selectively operating the two-position switch to connect the second side of the outlet receptacle to either the hot terminal or the switched hot terminal to selectively power the outlet receptacle directly from the hot line or through the remote switch from the hot line.

2. The mode selectable power receptacle of claim 1 wherein the two-position switch comprises a push button switch.

3. The mode selectable power receptacle of claim 1 wherein the two-position switch comprises a maintained push button switch.

4. The mode selectable power receptacle of claim 1 wherein the two-position switch comprises a momentary push button switch.

5. The mode selectable power receptacle of claim 1 wherein the two-position switch comprises a selector switch.

6. The mode selectable power receptacle of claim 1 wherein the two-position switch comprises a relay.

7. The mode selectable power receptacle of claim 6 further comprising a control circuit for operating the relay.

8. The mode selectable power receptacle of claim 7 wherein the control circuit includes a selector switch.

9. The mode selectable power receptacle of claim 1 further comprising a housing for the outlet receptacle and the two-position switch, the terminals being externally mounted to the housing.

10. The mode selectable power receptacle of claim 1 wherein a ground terminal for connection to a ground line is connected to a ground receptacle of the outlet receptacle.

11. A mode selectable power receptacle for use with a remote switch comprising:

first and second outlet receptacles each adapted to receive a plug having first and second terminals;

a neutral terminal for electrical connection to a neutral line of a supply, the neutral terminal being connected to a first side of each outlet receptacle;

a hot terminal for electrical connection to a hot line of the supply;

a switched hot terminal for electrical connection via the remote switch to the hot line of the supply; and first and second two position switches connected to the hot terminal, the switched hot terminal and a second side of the respective first and second outlet receptacles, each two position switch including an actuator for selectively operating the respective two position switch to connect the respective second side of the outlet receptacles to either the hot terminal or the switched hot terminal to selectively power the respective outlet receptacle directly from the hot line or through the remote switch from the hot line.

12. The mode selectable power receptacle of claim 11 wherein each two position switch comprises a push button switch.

13. The mode selectable power receptacle of claim 11 wherein each two position switch comprises a maintained push button switch.

14. The mode selectable power receptacle of claim 11 wherein each two position switch comprises a momentary push button switch.

15. The mode selectable power receptacle of claim 11 wherein each two position switch comprises a common selector switch.

16. The mode selectable power receptacle of claim 11 wherein each two position switch comprises a relay.

17. The mode selectable power receptacle of claim 16 further comprising a control circuit for operating the relays.

18. The mode selectable power receptacle of claim 17 wherein the control circuit includes a selector switch.

19. The mode selectable power receptacle of claim 11 further comprising a housing for the outlet receptacle and the two position switches, the terminals being externally mounted to the housing.

20. The mode selectable power receptacle of claim 11 wherein a ground terminal for connection to a ground line is connected to a ground receptacle of the outlet receptacles.

* * * * *